United States Patent [19]

Fremund

[11] Patent Number: 4,869,663

[45] Date of Patent: Sep. 26, 1989

[54] CHILD PROOF CIGARETTE LIGHTER

[76] Inventor: Zdenek A. Fremund, 4 Surrey La., Montvale, N.J. 07645

[21] Appl. No.: 247,631

[22] Filed: Sep. 22, 1988

[51] Int. Cl.[4] ..... F23Q 2/16; F23Q 2/34; F23D 11/36

[52] U.S. Cl. ..... 431/153; 431/277; 222/153; 222/402.11

[58] Field of Search ..... 431/153, 143, 277, 267, 431/142; 222/402.11, 153, 384; 251/89, 95, 111, 114, 115, 116

[56] References Cited

U.S. PATENT DOCUMENTS

| | | | |
|---|---|---|---|
| 3,328,980 | 7/1967 | Reim | 431/277 |
| 3,349,969 | 10/1967 | Velt | 222/153 |
| 3,574,502 | 4/1971 | Fuller | 431/267 |
| 3,744,953 | 7/1973 | Herr | 431/13 |
| 3,748,086 | 7/1973 | Retzler | 431/131 |
| 3,827,605 | 8/1974 | Knickerbocker | 222/153 |
| 3,828,981 | 8/1974 | Linkletter | 222/153 |
| 3,898,031 | 8/1975 | Rusakowicz | 431/130 |
| 3,922,139 | 11/1975 | Sugawa | 431/131 |
| 3,985,493 | 10/1976 | Neyret | 431/131 |
| 4,036,579 | 7/1977 | Marynissen | 431/131 |
| 4,144,018 | 3/1979 | Tanaka | 431/131 |
| 4,162,746 | 7/1979 | Anderson et al. | 222/153 |
| 4,569,654 | 2/1986 | Borghesi | 431/255 |
| 4,758,152 | 7/1988 | Kordecki | 431/153 |
| 4,776,491 | 10/1988 | Nitta | 222/153 |
| 4,784,602 | 11/1988 | Nitta | 431/153 |
| 4,786,248 | 11/1988 | Nitta | 431/153 X |

*Primary Examiner*—Carl D. Price

*Attorney, Agent, or Firm*—Abraham Wilson; Robert A. Green

[57] ABSTRACT

A lighter comprises a body containing lighter fuel and a vertically slidable fuel tube by means of which fuel can be brought from within the body to the vicinity of the sparking wheel of the lighter. The lighter includes a pivotable lever which raises and lowers the fuel tube and a two-position locking means which, in one position, permits the fuel tube to be raised and permits firing of the lighter and in a second position, prevents the fuel tube from being raised and prevents firing of the lighter.

2 Claims, 2 Drawing Sheets

FIG. 1
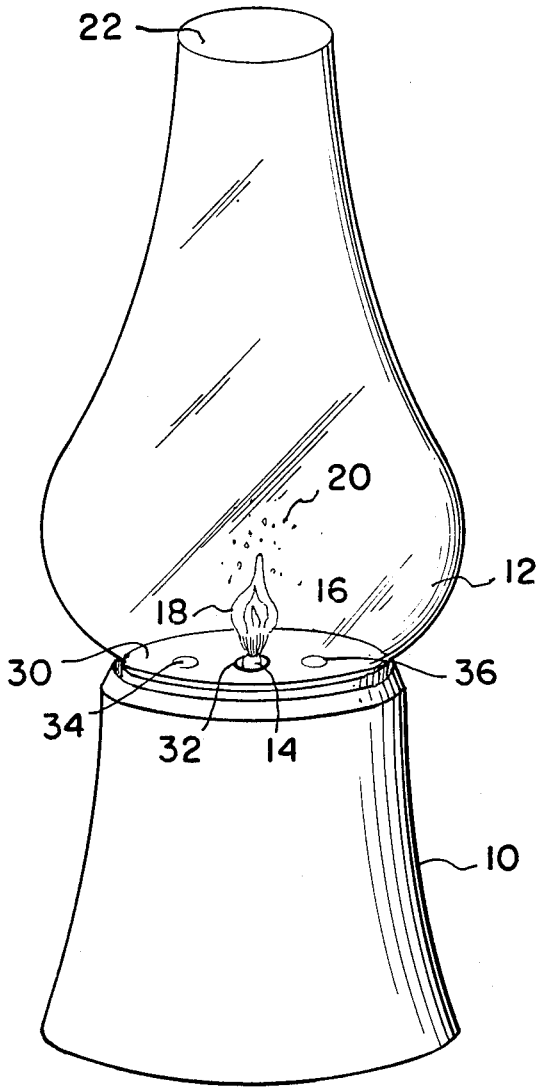
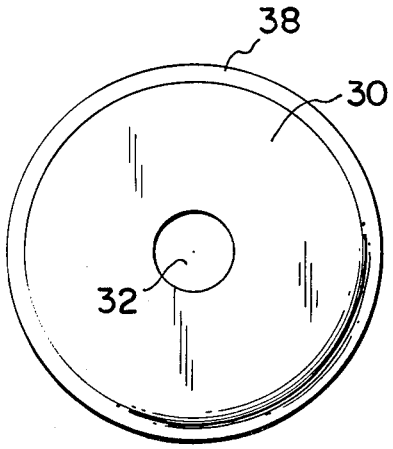
FIG. 2(a)
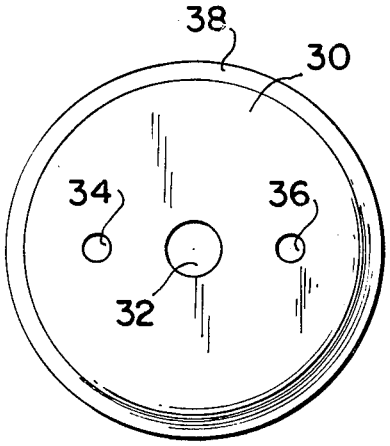
FIG. 2(b)

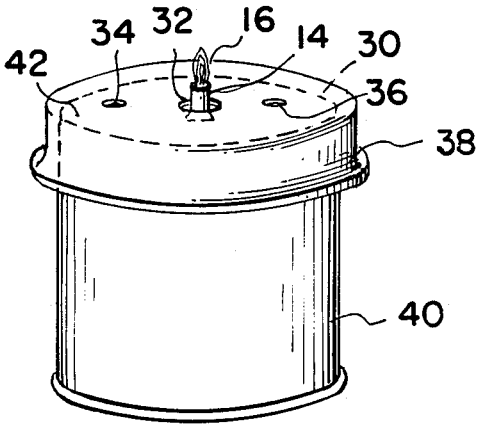
FIG. 3
FIG. 4
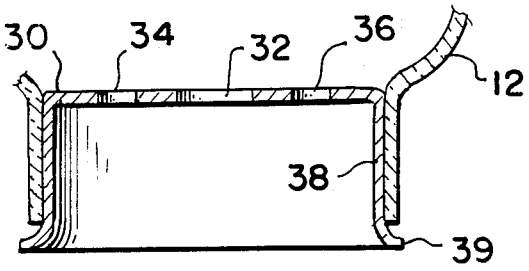
FIG. 5
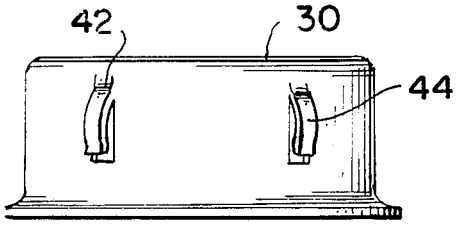
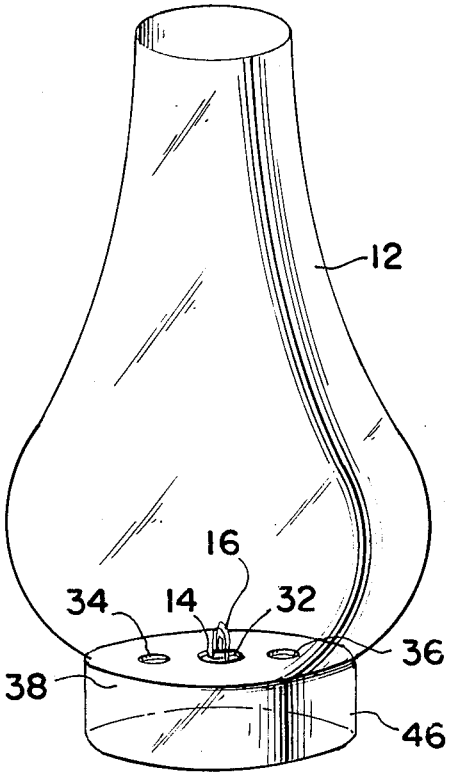
FIG. 6

CHILD PROOF CIGARETTE LIGHTER

BACKGROUND OF THE INVENTION

For a long time, there has been a need for a cigarette lighter which small children could not operate. The prior art contains several examples of lighters which may be considered to be safe lighters, with some type of safety mechanism, but these lighters are undesirably complex in structure and function than the lighter of the present invention.

Briefly, the principles of the invention may be conveniently embodied in one of the most popular throwaway lighters, however, it will be clear to those skilled in the art that the principles of the invention are widely applicable. Briefly, according to the invention, in lighters which have a spark wheel and a finger-operated lever for positioning a tube leading to the fuel supply in position for ignition, means are provided for either permitting operation of the lever or for preventing operation of the lever, this means being generally not operable by children.

DESCRIPTION OF THE DRAWINGS

FIG. 2 is an exploded view of portions of the lighter of FIG. 1; and

DESCRIPTION OF THE INVENTION

Figure 1:
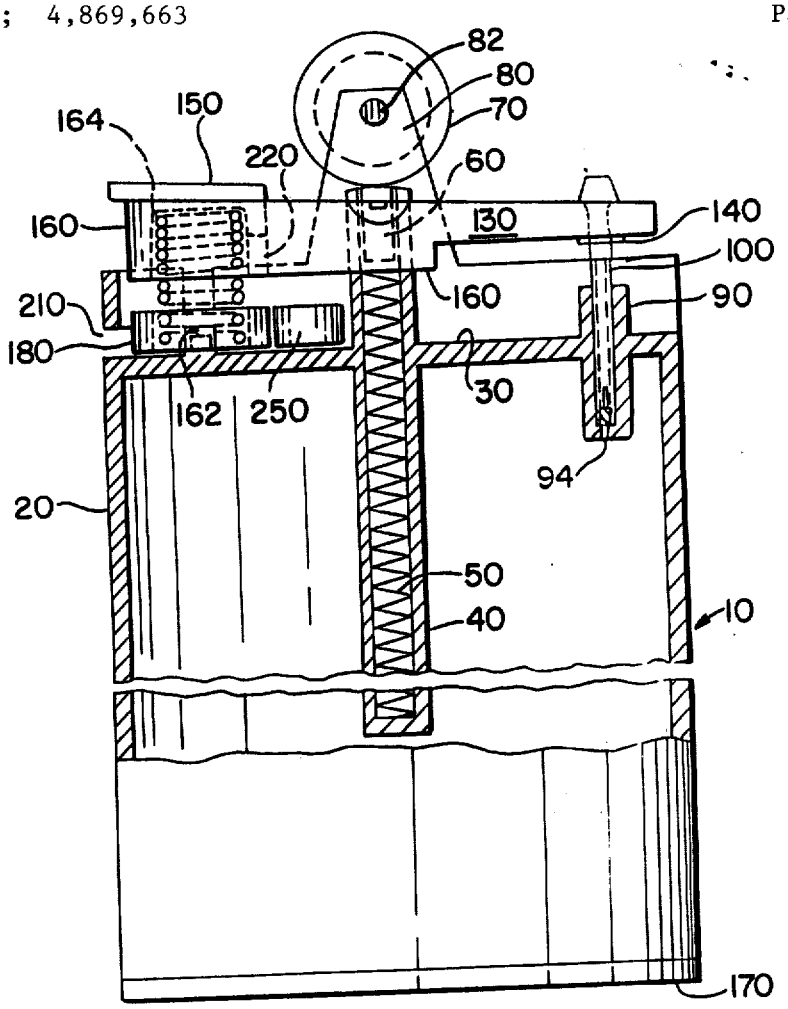
FIG. 1 is a side elevational view of a lighter embodying the invention.

One specific type of lighter to which the principles of the invention apply is shown in the drawings although it will be clear to those skilled in the art that the principles are broadly applicable. The lighter 10 includes an insulating generally tubular body 20 which includes an integral top wall 30. The top wall 30 carries an integral flint tube 40 at about its center and a spring 50 lies within the tube 40 with its upper end bearing against a flint 60 which in turn bears against a sparking wheel 70 rotatably mounted in holes 82 in vertical walls 80 formed integral with the lighter body 20 above the top wall 30.

The lever 130 also includes a peripheral depending wall 160 which provides strength and rigidity and may be of any suitable height considering the structure of the lighter 10 and its associated parts.

The top surface of the top wall 30, at the left end as seen in FIG. 1, is provided with a short locating dimple or post 162 on which a vertically oriented helical spring 164 is seated, the spring being of sufficient length to bear against the lower surface of the lever 130 beneath finger pad 150.

The lighter body 20 has a lower open end through which it is filled with fluid and an air-tight cap 170 seals this open end.

To the right of the flint tube 40, as seen in FIG. 1, is an integral fuel tube or sleeve 90 having a bottom wall which is provided with a small fuel orifice 94 which is accessible to lighter fuel in the body 20. A hollow metal fuel tube 100 is seated in fuel sleeve 90 and at its lower end it is provided with a solid plug 104 which blocks orifice 94 when the metal fuel tube is down as described below. The side wall of the fuel tube 100 is provided with one or more slots 106 which permit lighter fuel to enter the tube 100. The fuel tube 100 is slidably mounted, positioned vertically, within the fuel tube 90 and acts as a valve and a conduit of lighter fuel from inside the lighter body 20 to the vicinity of the sparking wheel 70. When the tube 100 is down, plug 104 closes off the fuel orifice 94 and when it is up, fuel can flow through orifice 94 and into slots 106 and into tube 100 and upwardly to the open upper end of tube 100.

A horizontal finger-operated lever 130 is pivotably coupled above top wall 30 by means of integral lateral tabs 134 seated in holes 84 in walls 80.

The lever 130 has, at one end, a hole 140 which receives the fuel tube 100 and at the other end it has a flat pad-like portion 150 on which the user's finger or thumb bears in operation of the lighter. The center of the lever 130 has a suitable opening 132 through which the flint tube 40 extends.

According to the invention, in order to prevent small children from operating the lighter, a locking lever 180 is provided. This locking lever is in the shape of a ring which is seated around the spring 164 at the left end of the top wall 30 as seen in FIG. 1. The locking lever 180 includes a post or pin 200 which extends laterally from the body of the locking lever through a horizontal slot 210 in the body 20 of the lighter 10 The slot 210 is of a suitable length for the intended purpose. The locking lever also includes an upstanding tab 214 which rises from the top wall of the ring body and is of a suitable height to achieve the purposes of the invention as described below. The depending wall 160 is provided with a notch 220, preferably where it lies adjacent to the flint tube opening 132. The notch 220 is dimensioned and positioned to receive the upstanding tab 214 of locking lever 180.

The spring 164 is provided between pad 150 and wall 30 to facilitate operation of the lever 130.

In normal operation of the lighter 10, the user presses down on the pad 150 of lever 130 against spring 164 and this pivots the lever 130 and raises the slidable fuel tube 100 and permits fuel to rise therethrough from inside body 20 to the vicinity of the sparking wheel 70 Simultaneously, the sparking wheel is rotated and generates a spark which lights the fuel emanating from the fuel tube 120. When the finger is released, the lever 130 pivots clockwise with the aid of spring 164, as seen in FIG. 1, the fuel tube 100 drops down stopping the flow of fuel by closing orifice 94 and the lighter goes off.

In operation of the invention to control operation of the lighter and to make the lighter operative, the locking lever 180 is positioned by the user pushing on the pin 200 to rotate the lever into position where the upstanding tab 214 is seated in line with and beneath the notch 220 in the wall 160 of the lever. With this arrangement, the lever 130 can be pivoted or pushed down by the user to permit the lighter to operate in normal fashion since the notch 220 receives the tab 214 and is not impeded thereby. To render the lighter 10 inoperative, the user pushes on the pin 200 to rotate the locking lever and move the tab 214 out of the line of the notch 220 and move it into position under the lower edge of the wall 160 so that the lever 130 bears against the tab 214 and cannot be pivoted by the user to provide normal operation of the lighter.

If desired a support spacer 250 may be provided secured to or, integral with the top wall 30 if convenient, to maintain the position of the locking lever 180 as it is rotated and to prevent it from shifting in position.

What is claimed is:

1. A child-proof cigarette lighter comprising a hollow tubular body containing lighter fluid and including a bottom wall having a fuel-filling opening and a cap therefor, said tubular body including a side wall and a horizontal top wall, a short mounting post secured to said horizontal top wall adjacent to one end thereof, a fuel sleeve secured to said top wall adjacent to an end thereof remote from said short mounting post, said fuel sleeve having an opening at its lower end which communicates with fuel inside said tubular body, a fuel tube slidably positioned in said fuel sleeve, first and second parallel upstanding walls secured to opposed portions of said side wall of said tubular body at the central portion of said horizontal top wall, first and second aligned upper mounting holes in said first and second upstanding walls and third and fourth aligned lower mounting holes in said first and second upstanding walls, a vertical flint tube secured to said top wall between said first and second upstanding walls with a spring-biased flint seated therein with the flint being at the upper end thereof, a spark wheel disposed between said first and second upstanding walls and having lateral mounting tabs seated in said first and second upper mounting holes in said upstanding walls, said spark wheel being seated against and engaging said flint in said flint tube, a horizontal lever disposed above said top horizontal wall of said hollow tubular body and having side mounting tabs disposed in said lower mounting holes in said upstanding walls whereby said horizontal lever is pivotably supported adjacent to said top horizontal wall, said horizontal lever having a central opening through which said flint tube extends and an opening at one end which engages said fuel tube and moves said fluid tube up and down, a relatively flat finger receiving pad at the end of said horizontal lever remote from said opening at said one end of said horizontal lever, said horizontal lever having a lower surface beneath said finger receiving pad and a tubular member extending downwardly therefrom, said tubular member having a slot in its wall and a lower edge, a spring vertically mounted and seated on said short mounting post and extending vertically therefrom into said tubular member beneath said pad, a locking ring rotatably seated on said top horizontal wall and placed over said short mounting post, said locking ring including a vertically upstanding post which bears against said lower edge of said tubular member in one position of said locking ring and is adapted and positioned to enter said slot in another position of said locking ring, said locking ring also including a horizontal post which extends through an opening in said side wall of said tubular body where it is accessible to an operator for rotating said locking ring to one position in which said upstanding post bears against said tubular member and prevents said horizontal lever from being depressed and operating said lighter and to a second position in which said upstanding post is located in said slot in said tubular member whereby said horizontal lever said horizontal lever having a tubular wall extending downwardly from the lower surface there can be depressed and said lighter can be operated in normal fashion.

2. The apparatus defined in claim 1 and including a guide plate secured to said horizontal top wall adjacent to said locking ring and holding said locking ring in place as it is rotated by an operator of said lighter.

* * * * *

UNITED STATES PATENT AND TRADEMARK OFFICE

CERTIFICATE OF CORRECTION

PATENT NO. : 4,869,663

DATED : 09/26/89

INVENTOR(S) : FREMUND

It is certified that error appears in the above-identified patent and that said Letters Patent is hereby corrected as shown below:

The title page should be deleted to appear as per attached title page.

Figure 3:
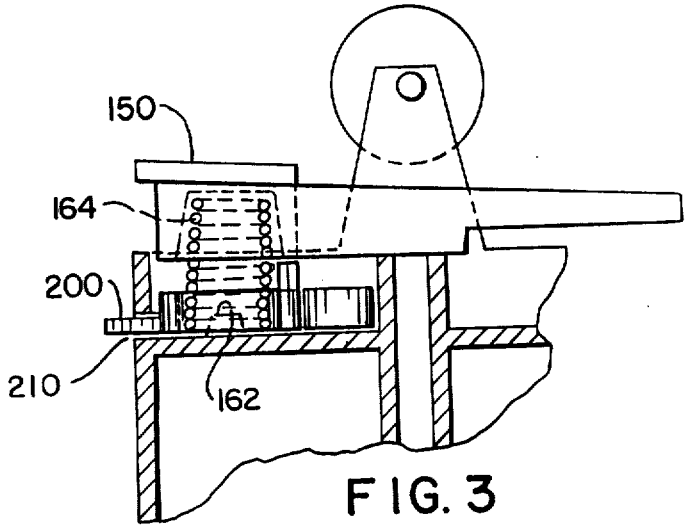
FIG. 3 is a side elevational view, partly in section, of the lighter of the invention illustrating operation of the invention.

Figure 1-6 should be deleted to appear as Figure 1-3 as shown on the attached sheets.

Signed and Sealed this

Sixteenth Day of March, 1993

*Attest:*

STEPHEN G. KUNIN

*Attesting Officer*

*Acting Commissioner of Patents and Trademarks*

United States Patent [19]

Fremund

[11] Patent Number: 4,869,663

[45] Date of Patent: Sep. 26, 1989

[54] CHILD PROOF CIGARETTE LIGHTER

[76] Inventor: Zdenek A. Fremund, 4 Surrey La., Montvale, N.J. 07645

[21] Appl. No.: 247,631

[22] Filed: Sep. 22, 1988

[51] Int. Cl.[4] ..... F23Q 2/16; F23Q 2/34; F23D 11/36

[52] U.S. Cl. ..... 431/153; 431/277; 222/153; 222/402.11

[58] Field of Search ..... 431/153, 143, 277, 267, 431/142; 222/402.11, 153, 384; 251/89, 95, 111, 114, 115, 116

[56] References Cited

U.S. PATENT DOCUMENTS

| | | | |
|---|---|---|---|
| 3,328,980 | 7/1967 | Reim | 431/277 |
| 3,349,969 | 10/1967 | Velt | 222/153 |
| 3,574,502 | 4/1971 | Fuller | 431/267 |
| 3,744,953 | 7/1973 | Herr | 431/13 |
| 3,748,086 | 7/1973 | Retzler | 431/131 |
| 3,827,605 | 8/1974 | Knickerbocker | 222/153 |
| 3,828,981 | 8/1974 | Linkletter | 222/153 |
| 3,898,031 | 8/1975 | Rusakowicz | 431/130 |
| 3,922,139 | 11/1975 | Sugawa | 431/131 |
| 3,985,493 | 10/1976 | Neyret | 431/131 |
| 4,036,579 | 7/1977 | Marynissen | 431/131 |
| 4,144,018 | 3/1979 | Tanaka | 431/131 |
| 4,162,746 | 7/1979 | Anderson et al. | 222/153 |
| 4,569,654 | 2/1986 | Borghesi | 431/255 |
| 4,758,152 | 7/1988 | Kordecki | 431/153 |
| 4,776,491 | 10/1988 | Nitta | 222/153 |
| 4,784,602 | 11/1988 | Nitta | 431/153 |
| 4,786,248 | 11/1988 | Nitta | 431/153 X |

*Primary Examiner*—Carl D. Price

*Attorney, Agent, or Firm*—Abraham Wilson; Robert A. Green

[57] ABSTRACT

A lighter comprises a body containing lighter fuel and a vertically slidable fuel tube by means of which fuel can be brought from within the body to the vicinity of the sparking wheel of the lighter. The lighter includes a pivotable lever which raises and lowers the fuel tube and a two-position locking means which, in one position, permits the fuel tube to be raised and permits firing of the lighter and in a second position, prevents the fuel tube from being raised and prevents firing of the lighter.

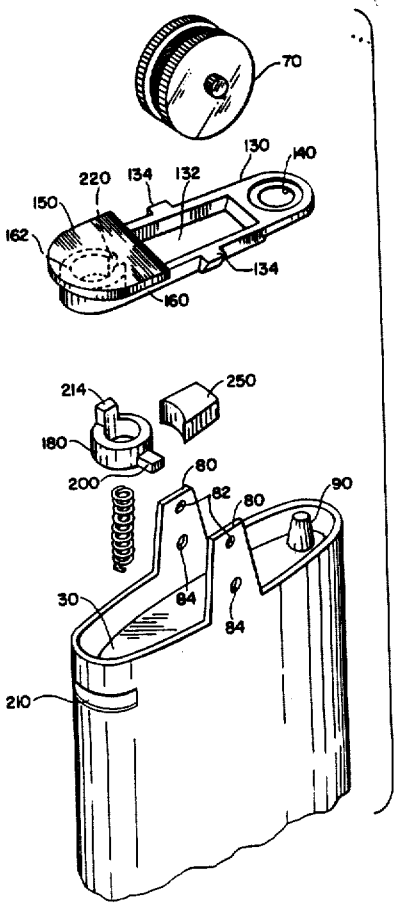

2 Claims, 2 Drawing Sheets